US008677876B2

(12) United States Patent
Diaz

(10) Patent No.: US 8,677,876 B2
(45) Date of Patent: Mar. 25, 2014

(54) 4D SIMULTANEOUS ROBOTIC CONTAINMENT WITH RECOIL

(76) Inventor: Kevin Mark Diaz, Watertown, MA (US)

( * ) Notice: Subject to any disclaimer, the term of this patent is extended or adjusted under 35 U.S.C. 154(b) by 0 days.

(21) Appl. No.: 13/538,068

(22) Filed: Jun. 29, 2012

(65) Prior Publication Data

US 2013/0014633 A1 Jan. 17, 2013

Related U.S. Application Data

(63) Continuation-in-part of application No. 13/184,505, filed on Jul. 16, 2011, now Pat. No. 8,240,239.

(51) Int. Cl.
*F41H 11/16* (2011.01)

(52) U.S. Cl.
USPC ..... 89/1.13; 102/402

(58) Field of Classification Search
USPC ..... 89/1.13; 102/402; 86/50
See application file for complete search history.

(56) References Cited

U.S. PATENT DOCUMENTS 2,005,392 A * 6/1935 Remus ..... 37/274
2,419,308 A * 4/1947 Austin ..... 89/1.13
3,820,479 A * 6/1974 Fylling ..... 109/1 R
3,837,259 A * 9/1974 Vaughn ..... 89/1.13
4,467,694 A * 8/1984 Azulai et al. ..... 89/1.13
4,552,053 A * 11/1985 Bar-Nefy et al. ..... 89/1.13
4,585,387 A * 4/1986 Jayne ..... 414/730
4,621,562 A * 11/1986 Carr et al. ..... 89/41.05
4,727,940 A * 3/1988 Bar-Nefy et al. ..... 171/84
4,901,644 A * 2/1990 Nevins et al. ..... 102/293
4,919,034 A * 4/1990 Firth ..... 89/1.13
4,932,831 A * 6/1990 White et al. ..... 414/732
4,938,114 A * 7/1990 Matthews et al. ..... 89/1.13
5,097,911 A * 3/1992 Kendall ..... 172/815
5,125,317 A * 6/1992 Spektor et al. ..... 89/1.13
5,263,809 A * 11/1993 Kent ..... 414/680
5,307,272 A * 4/1994 Butler et al. ..... 700/90
5,410,944 A * 5/1995 Cushman ..... 91/520
5,648,901 A * 7/1997 Gudat et al. ..... 701/23
5,712,441 A * 1/1998 Grunewald ..... 89/1.13
5,786,542 A * 7/1998 Petrovich et al. ..... 89/1.13
5,856,629 A * 1/1999 Grosch et al. ..... 89/1.13
5,869,967 A * 2/1999 Straus ..... 324/326
5,892,360 A * 4/1999 Willer et al. ..... 324/326
5,936,185 A * 8/1999 Tokuni ..... 89/1.13
5,988,037 A * 11/1999 Haughom et al. ..... 89/1.13
6,113,343 A * 9/2000 Goldenberg et al. ..... 414/729
6,343,534 B1 * 2/2002 Khanna et al. ..... 89/1.13
6,377,872 B1 * 4/2002 Struckman ..... 700/258
6,393,959 B1 * 5/2002 Amemiya ..... 89/1.13
6,681,675 B2 * 1/2004 Miller ..... 86/50

(Continued)

FOREIGN PATENT DOCUMENTS

DE 3820479 A1 * 2/1989 ..... A22C 5/00

*Primary Examiner* — Benjamin P Lee

(57) ABSTRACT

A semi-continuous duty, Green Technology, self-charging 14, unmanned electric vehicle providing protection and security from underground mines. A deflector blade 11 follows natural existing contours to maintain straight line paths, while simultaneously carrying a mine detector 10, a vertical reciprocating ram set 30, 32 and 33 that preloads soil while also creating forward motion, followed by an energy dissipation and containment canopy system 22, 24, 26 & 29. The comprehensive system provides protection from mines on existing pathways in desert environments using a self-sufficient energy source. In addition, the total system utilizes only Green Technology for all modes of operation.

8 Claims, 5 Drawing Sheets

(56) References Cited

U.S. PATENT DOCUMENTS

| | | | | |
|---|---|---|---|---|
| 6,809,520 | B1 * | 10/2004 | Nelson | 324/329 |
| 6,879,878 | B2 * | 4/2005 | Glenn et al. | 700/245 |
| 7,198,112 | B2 * | 4/2007 | Wanner | 172/19 |
| 7,228,927 | B2 * | 6/2007 | Hass et al. | 180/65.25 |
| 7,296,503 | B1 * | 11/2007 | McGrath | 89/1.13 |
| 7,493,974 | B1 * | 2/2009 | Boncodin | 180/2.2 |
| 7,540,540 | B2 * | 6/2009 | Kwon et al. | 285/411 |
| 7,565,941 | B2 * | 7/2009 | Cunningham | 180/167 |
| 7,600,460 | B2 * | 10/2009 | Manders | 89/1.13 |
| 7,683,821 | B1 * | 3/2010 | Clodfelter | 342/22 |
| 7,712,405 | B2 * | 5/2010 | Toycen et al. | 86/50 |
| 7,740,082 | B2 * | 6/2010 | Davidson et al. | 171/18 |
| 7,752,953 | B2 * | 7/2010 | Sokol et al. | 89/1.13 |
| 7,775,146 | B1 * | 8/2010 | Bitar et al. | 89/1.13 |
| 7,884,569 | B2 * | 2/2011 | Ward | 320/101 |
| 7,958,809 | B1 * | 6/2011 | Bitar et al. | 89/1.13 |
| 7,987,760 | B1 * | 8/2011 | Lundquist et al. | 89/1.13 |
| 8,499,675 | B2 * | 8/2013 | McCahon et al. | 89/1.13 |
| 2008/0236376 | A1 * | 10/2008 | Reeves et al. | 89/1.13 |
| 2009/0223355 | A1 * | 9/2009 | Manders | 89/1.13 |
| 2009/0250276 | A1 * | 10/2009 | Goodwin et al. | 180/65.265 |
| 2010/0275472 | A1 * | 11/2010 | Cunningham | 37/403 |
| 2011/0259181 | A1 * | 10/2011 | Lundquist et al. | 89/1.13 |
| 2012/0125182 | A1 * | 5/2012 | Lundquist et al. | 89/1.13 |
| 2012/0210854 | A1 * | 8/2012 | Bitar et al. | 89/1.13 |

* cited by examiner

4D SIMULTANEOUS ROBOTIC CONTAINMENT WITH RECOIL

This application is a Continuation-In-Part of application Ser. No. 13/184,505, filed Jul. 16, 2011 now U.S. Pat. No. 8,240,239.

BACKGROUND

Prior Art

The following is a tabulation of some prior art that presently appears relevant:

| U.S. Patents | | | |
|---|---|---|---|
| Pat. No. | Kind Code | Issue Date | Patentee |
| 7,493,974 | B1 | 2009 Feb. 24 | Boncodin |
| 5,856,629 | | 1999 Jan. 05 | Grosch et al. |
| 6,343,534 | B1 | 2002 Feb. 05 | Khanna et al. |
| 2,005,392 | | 1933 Apr. 18 | Remus |
| 4,589,341 | | 1986 May 20 | Clark |
| 4,519,543 | | 1985 May 28 | Szuminski |
| 6,216,740 | | 2001 Apr. 17 | Bunya |

This invention relates to a solar charging, battery powered, unmanned mine defeat vehicle. Current situations in specific geographic regions of the world have created a new need for defeating underground mines in desert-like terrain. This vehicle is especially to be used on existing paths in sand environments worldwide to protect against death and dismemberment, a long-time priority issue and establishes an effective tool for safe passage and security monitoring and creating secure zones. Both the facts of presence of underground mines as well as the importance of deterrence and prevention of positioning new mines are widely available to individuals. The necessity for addressing the issue of travel protection by foot on paths consisting of bare ground is the focus of the new vehicle as presented. The invention has the advantage of operating with Green Technology only and in areas that do not have conventional AC (alternating current) for charging or common petroleum based fuel sources for conventional gas engines.

The unfilled need for defeating mines in environments such as opens fields, village passages and trails between villages has always needed a method of solution. As the use of mines was common for numerous years, millions of mines are located and placing an equivalent number of humans at risk. Many solar powered vehicles exist but do not comprehensively address mines. Many methods exist for the protection from mines for personnel vehicles. Recent studies have indicated that a new degree of effort must be made spent into the success of what is first step to defeat of mines, that of limiting the placement of them. Thus creating the benefit of secure areas. Proactive security and containment is simultaneously performed as the vehicle functions to prevent further placements of mines.

Several types of solar vehicles and minesweepers for detection and destruction of mines are known, each with a disadvantage. Many solar powered vehicles exist but do not comprehensively address mines. Many methods exist for the protection from mines for personnel vehicles and utilizing unmanned robots. The previous patent for a solar vehicle U.S. Pat. No. 7,493,974 to Boncodin is for human transportation. A minesweeping vehicle, U.S. Pat. No. 5,856,629 granted to Grosch et al. is for wide-open spaces. The U.S. Pat. No. 6,343,534 to Khanna et al utilizes many latest methods for detection without a simultaneous in place trigger and containment system or marking process. The previous U.S. Pat. No. 2,005,392 to Remus addresses the use of a deflector with the disadvantage of flat surface use only. U.S. Pat. No. 4,589,341 to Clark discusses a chute but is for foam use. The U.S. Pat. No. 4,519,543 to Szuminski describes nozzles on a jet aircraft. The patent of Bunya, U.S. Pat. No. 6,216,740 acts to only control the manifold operation.

This application is a Continuation-In-Part of application Ser. No. 13/184,505, filed Jul. 16, 2011. This invention improvement relates to the assemblies for use where economy of energy must be achieved for the controlled pressure application, dissipation and vehicle stability for the mine defeat system. There are several elements which are additive and independent included for various levels of performance. The particular machine described in the application is presented in its best mode for a single pathway clearing system as described in this specification. Synergy exists in the assembly of apparatus by first being blast triggered by the closer initial offset distance towards the mounted blast plate at the rear of assembly which is strut mounted to the vehicle platform. The pressure field is relieved and dissipated by the system of energy absorbing struts, billows curtains and expanding canopy. The machine reacts rearward and upward as the pressure is relieved in the pressure wave direction and each side flexible face, functioning as a 3D dissipating containment system.

This equipment clears a minimum, substantial 32 inch wide path, for personnel in single file traversing pathways with detection, verification, sensors, surveillance, disarming, detonation, containment and path marking all in one process. This method of defeating a mine keeps people and personnel at a distance from the hazard with prevention, simultaneously. Pressure wave, fire and fragmentation from all mines occur within milliseconds of triggering the device and it is necessary to defeat this type of device from placement to containment, specifically anti-personnel type mines. The one vehicle makes available the necessary functions of soft protection methods and direct mechanized means. This addresses the two-part problem of mines, protection from initial placement while also providing safe detection, removal and containment, a combined comprehensive approach to defeating mines.

SUMMARY

It is the objective of the present invention to create a new use for a solar powered vehicle to provide a improved combined compact mine detector, monitor and sweeper and containment apparatus in the most austere environments to run without conventional fuel driven power using only Green Technology. The vehicle is a battery based DC (direct current) motor drive recharged with a solar module attached onto the forward sloping frame. It does not require daily fueling. Introducing equipment that is designed to be small in size and intended to be durable and cost sacrificial utilizing mechanical and detection means having the advantage of self-contained capabilities. The goals and approach are solely based on control of spaces at risk to mine placement and provide a cost-effective, high performance solution with known survivability limitations and budget-sacrificial equipment loss and only life saving and casualties reduction made as a variables of measured value.

Operation speed and maneuvering including tight turning is afforded by the fact of equal wheel base to track width yielding nearly a zero turning radius. Any of the customary control methods are possible, including remote or wired joystick as leader-follower arrangement, satellite, or run automatically on memory-learned pathways for routine path mine checking.

Common current field practice operating unmanned vehicle involves avoiding and maneuvering around debris and small stones and rocks, which lay in a straight-line path between two points of the objective route. In order to remedy this in an efficient condition of operation, an alternative method is made available as an option to drive in more direct pathways. A preferred method of ground preparation is to produce a near free of debris surface as possible. As an advantage, a debris deflector that has multiple panel segments, which naturally track downward onto the existing path cross-section, carries out ground preparation. The self-leveling debris deflector is counterweighted for a net self-weight of approximately a 3-pound net downward force per segment. The assembly remotely retracts for transportation to site. The assembly remotely retracts for protection during deactivation attempts or detonation.

Remote retractable robotic arm is deployed from recessed chamber to execute disarming when desired. An air tube routed to the deflector base from the gas ejection system is a tool for air blasting sand to uncover mines. Optional sensors read incoming path profile and controls deflector and probe assembly. The feedback loop created maintains a telemetry system for all ground sensors. Procedure also may include sidestepping mine and installing a flag for the affected area.

For normal conditions, the vehicle travels and a simultaneous area proofing and containment countermeasure system operates, a new countermeasure for field use. A specifically arranged configuration and assembly for replicating foot motion and pressure with a compound articulating mechanism is employed. A controlled pressure (0 to 30 psi) vertical reciprocating system for mine activation is utilized for positive soil contact and pressure to be delivered across the width of the vehicles pathway. A curtain billows, plate and canopy system for detonation dampening for expansion is utilized. A secondary fast response counter deployment system for canopy ejection is also presented.

The various elements that work together or individually in turn function together in an accumulating efficient manner reducing battery load requirements to operate the vehicle mechanical functions and computer systems. The components and assemblies are described as a prestage gas ejection detector, probe head boot, a strut probe assembly to impart a minimum of downward force, a timed pressure manifold for strut(s) and a strut energy dissipating canopy with chute.

As the prevention of mine accidents is paramount, longer operating times for the mine defeat system are preferred increasing daily service time. Each element described contributes to lowering energy demand and/or vehicle stability.

As the vehicle has its vertical probe assembly attached to the vehicle for clearing mines from a pathway, a strut can be used to provide a downward force. This force is used to drive the reciprocating probe which has the added potential of drawing dynamic energy from its' speed in impacting the ground. A constant pressure control is introduced in a timed manner through the use of the pressure manifold and relay to achieve the lower reaction force when the probe is not in extension mode for each cycle.

The pressure manifold and relay is located in an area away from the containment space. It combines the signaling of the probe head cycle for probe extension with the opening and closing of volume space in the strut(s). The function of controlled volume is provided with the primary feature of strut rod movement. Additional mine detectors will enhance the triggering to dissipation process.

The ability of the machine's probing units to move along will be improved by utilizing carbon fiber or other blast resistant material wrapped around the base of the probe or shoe acting as a flexible boot. A positioning of a mine detector will allow for prestage gas ejection. The probe head assembly may utilize a control ball knuckle for limited directional range of motion.

The placement prevention of mines is simultaneously done in a passive format through constant motion and personnel verification using a 360-degree turret to create safe-zones, which is a primary focus for all countries. In each typical village, small areas shall benefit, primarily villages and village connecting trails. Rotation of the camera of 45 degrees to left and right provides 360 degree of coverage with the turret operational. The majority of mines are delivered and set in place by individuals or groups who reside outside the community or village at risk. As an advantage in the self-contained and efficient capabilities, the vehicle is able to continuously perform motion detection and identification checking, through this simple but new effective data gathering technique.

At the rear of the containment plate are mounted three trailing hooks left, center and right.

A path marking system for centerline and low spot paint applicator is the last apparatus mounted.

Thermoelectric chips may be assembled in various arrays with a concentrating prism lens to add to the recharging abilities.

As an improvement accessory, where the surrounding terrain requires a better traction, the vehicle has the ability of use of additional flexible tracks to be field installed.

Adjustment for width of path utilizing all or any these devices is possible for wider or narrower path requirements.

DRAWINGS

Figures

Figure 1:
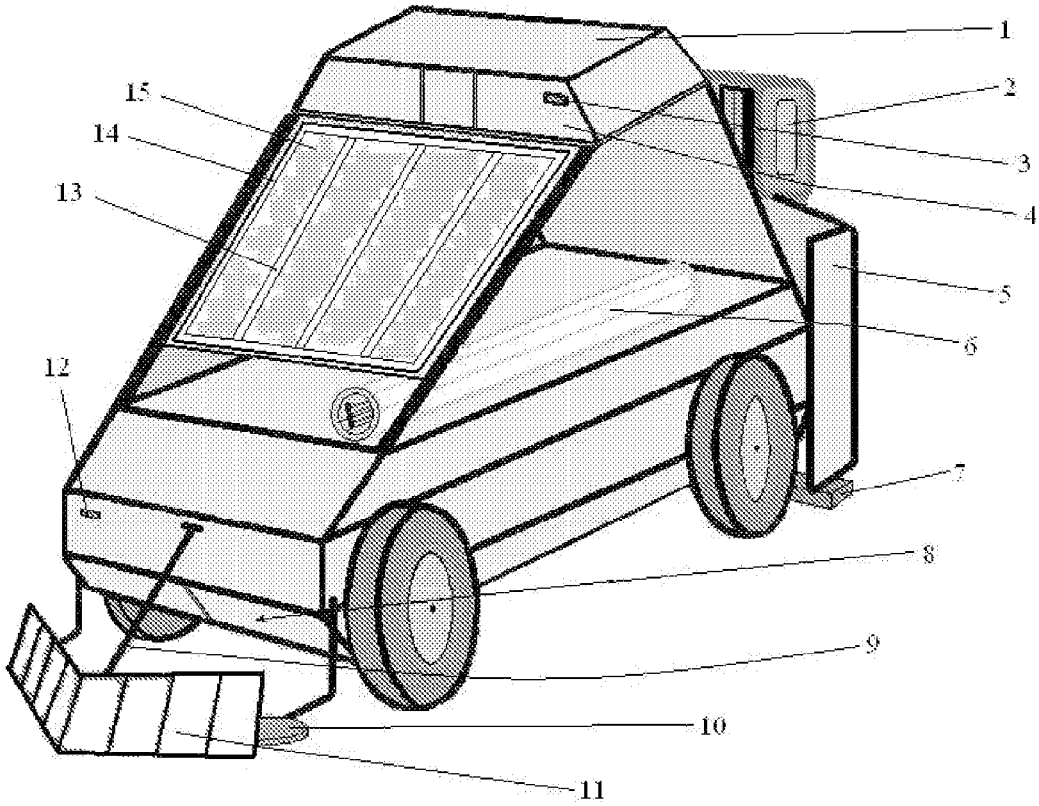
FIG. 1 is a perspective schematic view of a solar powered minesweeping vehicle according to the preferred embodiment of the invention.

| Drawings - Reference Numerals | |
|---|---|
| 1 | turret |
| 2 | canopy |
| 3 | camera |
| 4 | slide black Box |
| 5 | rear Blast plate |
| 6 | flag deployment system |
| 7 | vertical reciprocating system |
| 8 | concealed robotic arm system |
| 9 | self leveling system |
| 10 | detector |
| 11 | deflector |
| 12 | $2^{nd}$ Camera |
| 13 | glass |

-continued

| Drawings - Reference Numerals | |
|---|---|
| 14 | solar Module |
| 15 | photo voltaic cells |
| 16 | wheels |
| 17 | chassis-body |
| 18 | DC motors |
| 19 | batteries |
| 20 | turret |
| 21 | chassis-body |
| 22 | gas system |
| 23 | gas tanks |
| 24 | canopy |
| 25 | curtain billows |
| 26 | rear blast plate |
| 27 | mounting rod |
| 28 | hinged sliding spline control bracket |
| 29 | strut-cartridge |
| 30 | strut-cartridge |
| 31 | control volume solenoid valve |
| 32 | vertical reciprocating power-head |
| 33 | axial actuator |
| 34 | wheel |
| 35 | remote deployable flag |
| 36 | open edge |
| 37 | trigger |
| 38 | anchor base |
| 39 | powder actuated anchor |
| 40 | open edge |
| 41 | optional additional anchor base |
| 42 | spring to rod connections |
| 43 | pressure activation lines |
| 44 | pressure system |
| 45 | apron |
| 46 | probe boot |
| 47 | probe shoe mine detector |
| 48 | curtain billows |
| 49 | strut-cartridge |
| 50 | chute |

DETAILED DESCRIPTION OF EMBODIMENTS

Figure 2:
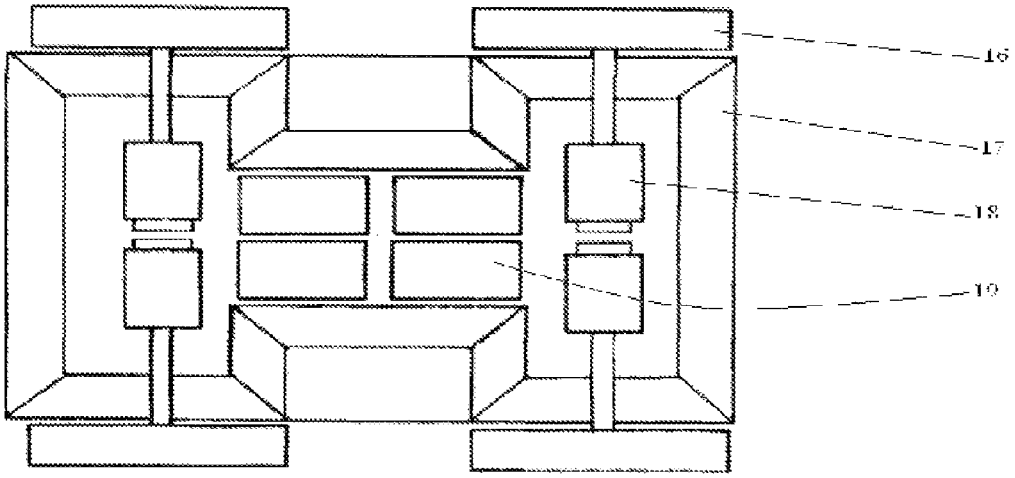
FIG. 2 is an interior schematic section showing the chassis-body-drive arrangement.

As shown in FIG. 1, is a new use non-conventional sized battery powered, solar charged, unmanned vehicle that is sized so as to create a clearing path for people travelling on foot. The first apparatus 11 is the self-leveling debris deflector. The primary chassis contains a solar panel 14 with a high resistant and magnification surface 13. From FIG. 2, a vertical interior section view looking down with the four drive wheels 16 can be found. Inside the chassis 17 are normal DC drive motors 18, current controller means and the battery set 19. The top of the chassis provides space for an optional bio-fuel power-plant that is not necessary but would provide added daily service hours that may be of advantage. In front of the chassis is an optical camera 12 for close in monitoring of operation of robotic arm that is stored in a recessed chamber 8 and for warning flag positioning. Above the chassis is a structural frame, which acts to support the photovoltaic cell module 14. This panel is secured to the frame with isolation attachments should an event causing toppling occur. The panel surface is damage resistant.

The supporting frame is also a shock cage, which has internally telescoping cylinders for force dampening. Above the shock cage is the turret 1 which is able to swivel horizontally 355 degrees. The turret 1 contains two optical cameras 3, one forward that creates 3D vision when synchronized with the lower chassis camera 12 and one to the rear for real time monitoring and motion detection and verification. Motion to identity security containment and control is accomplished. This significantly protects those registered in the safe zones and residing in the secured areas with personnel and civilians using IC Card verification. A simultaneous process of motion detection with verification of safe zone identification signals is read by computer hardware in the black box 4. Establishing this security process in any area of mine placement activity defends against further mines from being placed. The onboard capacity contains the logistics that would assemble information into a centralized database for use with and for field personnel to access this remote mobile vehicle. Information integration and analysis becomes real time. Verifying ID, document check, and controlling a single identification is extremely crucial as the ease of multiple identities is wide spread. Selective biometric applications involving identification cards containing radio frequency capacity technology for control movement in secured zones. Modernization programs rely on individual identification cards being required to carry. The following soft approach abilities for data gathering are presented for use in an efficient integrated fashion at low cost. Each optical camera is included in a self-contained blast resistant removable black-box 4, one on each side of the turret, which contain operational control and communications integrated circuits and hardware. The turret is also supported from the rear by the back wall, hinged at the top, for additional dampening benefit The self-leveling and retractable debris deflector 11 is illustrated in FIG. 1. Each panel section is slightly angled from the vertical and from the path centerline forward, so as to give a rolling momentum impact force out and away from the path of vehicle. Each panel segment is connected by a simple hinge-pin mounted at mid-panel height. The panels are overlapped so as to create uniform coverage while sloping up or down on the path's surface. From the existing ground surface, tines are placed which act to catch and clear individual stones larger than ¾ inch round in size. The deflector panel assembly is fitted with guide rollers, which produce very little downward force when not mechanically controlled with a height sensor controlled system. The assembly is supported by two side arms that act to maintain a controlled forward projected distance from the chassis and allow for upward rotation retractability when not in use. The total assembly creates a self-leveling effect. Immediately behind deflector panel assembly is mounting table and detection device 9.

The primary countermeasure system is illustrated in FIG. 1 and is a new assembly or unique apparatus for simultaneous triggering and containment of mines. The three features are shown at the rear of the vehicle. The vehicle may work in reverse direction where hazards are extremely high to maximize containment advantages. At the rear of the vehicle a vertical reciprocating system is shown 7, followed by a containment plate 5 and covered by a canopy deployment system 2.

Figure 3:
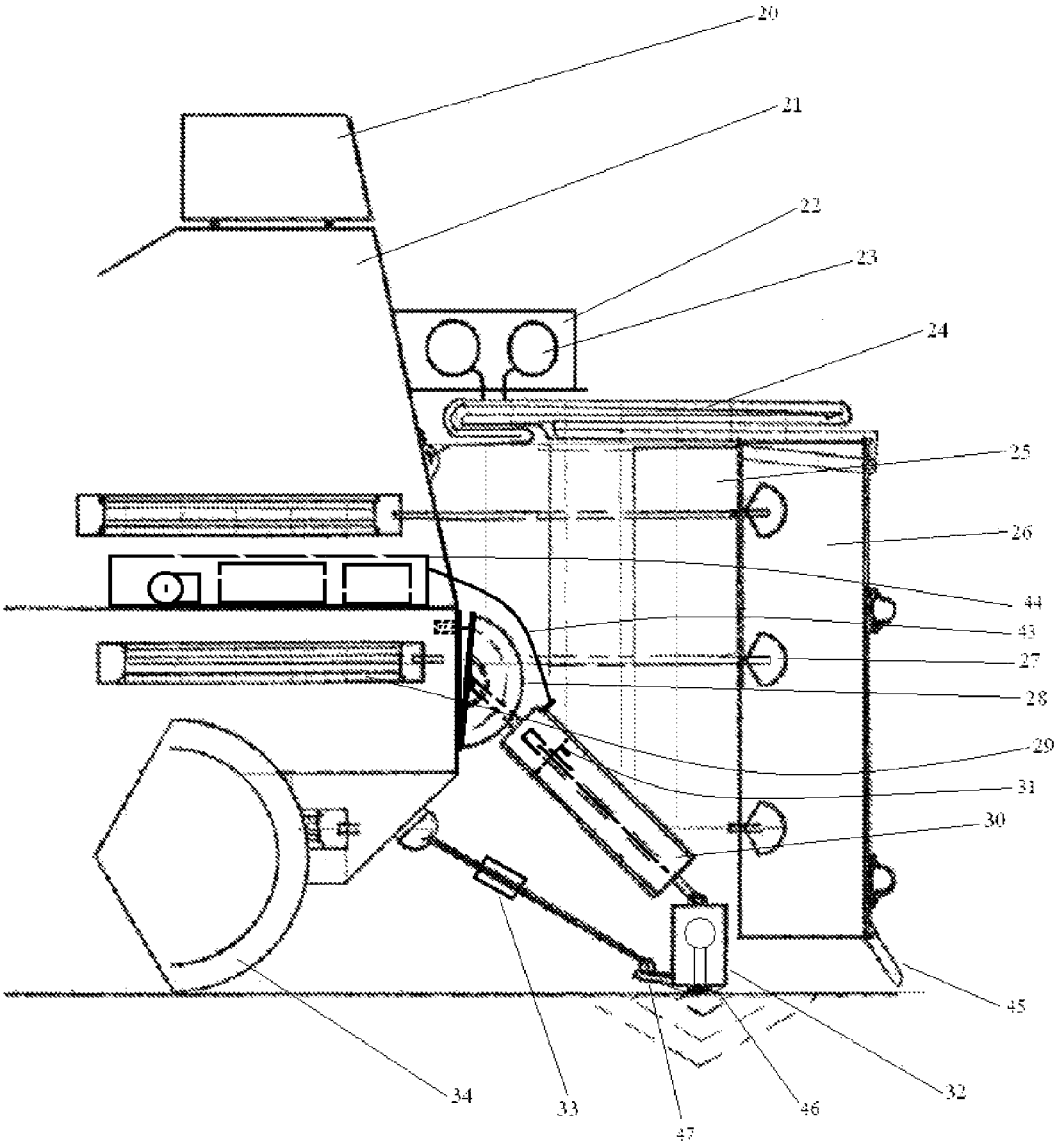
FIG. 3 is a side elevation schematic view depicting the configuration of the mine countermeasure system.

From FIG. 3, the rear of the vehicle can be seen. At the ground surface, each reciprocating foot 32 assembly has a determined width, which applies the appropriate pressure based upon the range of in-situ soil shear strength present where mine detection is to take place. The advantageous feature being created is that the reciprocating system assembly self-propels itself in two distinct ways. First, the individual line of action is inclined a few degrees from vertical, as a foot does. Secondly, the lower control arm has an axial actuator, which has a controlled advance throughout the timed cycle of operation. Each foot has a power head that provides a means of rotation and a controlled variable positive soil displacement, which acts to alter soil at or below surface and accomplish the mine trigger objective by simulating foot pressure and motion. Accomplishing triggering, ignition or downward force may be by any means known in the art.

The modular, preloaded feet with reciprocating probes are signaled to cycle in a timed fashion for maximizing the net downward force. Downward force for each assembly is provided by a preloaded pressurized strut 30, supported by a vertical spline control bracket 28, which limits horizontal range. The configuration of this apparatus is designed to remain in a horizontal orientation for existing ground undulations of plus or minus three inches and maintain continual ground contact.

From FIG. 3, an improved embodiment may be utilized in the form of a dissipating strut and probe assembly for the clearing of mines from pathways. To ultimately reduce the drag for motion and improve vehicle stability, a plurality of elements are utilized to work together or can be used separately.

In this embodiment for said dissipating struts 30, an improved strut performance can be realized. Each strut utilizes a control volume for manipulating the amount of gas/fluid to be displaced during extension and compression. While the reciprocating function of the probes are under way, the control of downward force is controlled in a cycled manner from a lower pressure value to a timed and synchronized higher value. Both values are able to be controlled by the predetermined size of vessel and the internal rate of displacement from the rod extending or compressing when entering and exiting the strut cylinder. The cycling operation is activated by the use of an internal solenoid valve 31 mounted into the control volume wall which when activated opens and closes the additional internal control volume within the strut chamber. The cycling timing of the solenoid valves is accomplished by the computer or a separate controller which sequences the strut high pressure level with the probe extension.

In another embodiment, a pressure system 44 with accumulator and manifold has pressure activation lines 43 connecting from the dissipating struts to a timed pressure manifold and relay system which combine electrical signals and line energy to open and close manifold valve ports, extend each probe assemblies, being branched and controlled separately to sufficiently cycle the probe extension with high strut pressure in a sequential manner. A controller sends signals to the relay of the manifold and to activate the probes together in a cycled and sequential manner of operation. Activation lines may be energized in an air, electrical and/or hydraulic manner. A combination of the two methods may be utilized for maintaining redundancy and improving reliability.

The strut controls the amount of downward force on the probe head. The overall assembly may be raised or lowered by rotation through a hinge located on the spline bracket and may be by hydraulic means. The spline plate brackets may be used independently for each strut and probe assembly or mounted on a single plate. The movable plates and their positions have a maximum load rating in the extended down operation position that freely release upon detonations by means of a breakaway link, load failure device or other load limiting mechanism that may incorporate an axial piston or other suitably fashioned device to relieve over-pressure. The primary combined feature is a piston lowering the hinged plate and upon a specified overload pressure, the plate rotates closed and simultaneously slides up for a short distance. This combined mechanism and load path creates a deadening effect for the short duration of the pressure wave.

As an alternative, another possible arrangement for the probe head connection and to maintain vertical orientation of the probe action is through the use of a modified connection, a spherically seated control knuckle providing a limited range of rotation. This may allow for more extended use in the field should damage occur. In this embodiment, the base of the strut rod is connected in a vertical plane hinged manner, with a slight degree of out-of-plane deflection possible, to follow the existing ground profile. One embodiment of the connection is to use a control knuckle which has a ball or spherical shape connecting to a similar shaped receiving yoke type socket mounted vertically into the top or side of the probe head surface. The top of either type ball shape used is further guided and controlled in a single vertical plane direction with limited angular range of motion in both rotational directions, accomplished by having a rectangular opening in the top of the socket face and attached to the probe head. The load exerted through such an assembly causes forces to be transmitted normal to the plane, perpendicular to that mounted plane which achieves a desired inherent self-balancing downward force. Said knuckle design may allow for single connection to probe head should damage occur to other links. This forged spindle ball joint has a controlled seat.

The strut assembly may have a critical break-joint design feature to have a planned strut loss to enhance vehicle stability. The break joint may consist of a reduced section of the strut rod or an equivalent means for high load failure. A plurality of mounted dissipating strut assemblies are possible. Each strut assembly may have a pressure limit valve or blow-off for relief of pressure in or on the strut housing for relief activation during the mine event.

The probe head contains the means for providing a reciprocating probe element. Additional mine detectors will enhance the triggering to dissipation process with an advance signal to start. This may be created by positioning the mine detector sensor on or near to the probe head. In operation, as the machine is in motion, a mine detected or located near to the probe head mine detector sensor 47 sends a feedback loop signal for gas ejection to start a few moments before the probe detonates the mine.

Any type mine detector known to exist and in the art may be attached and located in any position on the vehicle which would assist in the determination of the specific location of below or above ground mines. Mine detectors are commonly located as close to the ground as practicable. Guide roller surfaces may be included in the induction field circuit. Mine detectors may be added at the base of the deflector segments in a variety of connection means such as attachment to the individual deflector segments and probe head shoes through the use of small connection tables, brackets and shelves as well as a more ruggedized, potentially molded integral assembly, whereby the individual parts, such as but not limited to the deflector plate segments, sensors or probe head shoes form an integral, composite or a detachable-attachable assembly. The individual mine detector sensors can be hinged with springs to allow further improved ground clearances, pitch and angle of incidence and be attached by any practicable means known in the art including as a slide or snap on component. The attached mine detector mounted on the front of the vehicle locates mines. As these mines are located, a signal is sent through the feedback loop and are recorded for relative location which also may include positioning by satellite in the on-board computer located in the blackbox. The location of the vehicle is converted into data by two methods. The first is by common GPS positioning. The second is by surveyed range locators that are read by sensors on the vehicle for grid locating and stored on the computer. Other means for determining and storing distance travelled and grid location, along with user remote control exist to those skilled in the art. The blackbox protects these remote controlled, automatic and guidance control features for operation. The machine having possession of this information, along with its inherent motion tracking, calculates by means of computer when the mine shall approach the rear probe assembly with mine detector. As the machine is working its' way forward or backwards and nears the located mine, the gas ejection system is activated at a predetermined time or manually before detonation. Detonation may be accomplished by any of the known methods available known to those skilled in the art.

When the mine detector encounters a mine, an electrical signal is sent to the computer for creating a grid location using known range locators. Satellite positioning data for longitude, latitude and elevation is recorded in the computer. The gas ejection system is started for the release of gas. The gas may be stored in vessels under high pressure in a protective enclosure mounted to the vehicle. The mine detector sensor signals the computer via the feedback loop and activates the solenoid valves or other means of automated valve opening actuation being electronically controlled by the detector sensors or the computer located in the blackbox. The overall operation of the machine is synchronized by the onboard computer using integrated circuits which may be remotely operated. Any means of directing gas common to the art may be used, openings, ports or nozzles to control and direct the flow of gas upward, such as a plurality of ports, outlets, tubes or nozzles which effectively direct the gas jet in the directions desired. Upward directed gas shall deploy canopy and have detonation balancing force and horizontal force to either assist to propel in the forward or rearward direction. Control of gas ejection in any direction is controlled by the computer or remotely for thrust and exhaust velocity. As an example of control of gas, a series of electronically controlled automated valves controlling the gas in each direction can synchronize the control of gas in the desired directions. Other means of gas ejection exist in the art which create sufficient gas ejection and downward force to assist in the counterbalancing of the machine or vehicle before, during and after detonations for improving vehicle stability.

The combined elements of probe head, probe head shoe, probe and prestage detector or parts thereof may be covered for ease of sliding motion over the ground as well as protection, by a flexible carbon fiber or blast resistant material acting as a boot 46 or jacket element for additional guarding against sand and foreign elements. The material of the boot shall be flexible to allow for the repeated probe extension cycles. The Green Energy Mine Defeat System improved components enhance the performance and stability while reducing maintenance time for longer durations in-service.

Behind the vehicle chassis 21 is a containment blast plate 26, positioned upon status change to encompass the projected inverted conical zone of pressure, fire and fragmentation. Connecting the chassis to the blast plate is one variant of gas-fluid cartridges 29 with stepped release (0-200-800 lbs), which are body to plate connected, used as a dampening struts. The entire assembly is raised and lowered when not in use.

The billows 25 and curtain 25 are attached and assembled in accordion like manner on and along the sides of the containment space. The canopy 24 is attached in a folded parachute manner. Both are of a blast resistant material such as carbon fiber or better. As the mine is triggered, the blast plate and vehicle are lifted and sent in different directions. The blast travel distance is slightly less in distance to the blast plate 26. Therefore, initially causes a reverse direction of the total assembly. Through this action and the gas-fluid cartridges 29, energy is dissipated with a reaction being centrally resisted by the mass and size of the reciprocating system.

As those reciprocating system parts that are in ground contact and above are broken away as a reaction to the mine detonation, a feedback loop is broken and a fail safe signal located along the feet is tripped on, when the connection is broken. The connecting arms are limit rated and are subject to the first and highest levels of stress. Upon the signal being sent to the optional gas ejection system 22, a propelled inert gas and fire suppression 23 system is activated for canopy deployment in an upward and reverse impulse direction. The canopy chute 24 path and speed is maximized upward for containment and canopy deployment from the top of assembly. A conventional set of three trailing hooks, left, center and right edges of the rear containment plate of the vehicle are employed to activate underground trigger mechanisms for offset hazards of aboveground, concealed mines.

In another embodiment, the canopy may have an intermediate or top section that is modified to mitigate the resulting pressure, fire and fragmentation. In this arrangement a single or multiple series of rectangular rings consisting of extensible rods, corner bars, and struts are used to form a strut ring. Other shapes to establish containment strut rings such as ovals, triangles, circles, polygons or curvilinear outlines are also possible. The resultant grouping from pressure wave reactions are established, the corresponding best shape fit which best dissipates the shock, pressure wave and fragmentation event.

The corners of the rectangle form reaction points. The corners have connectable ends which are able to make connection with pressure relieving struts 49, which may be telescopic. These components may be either for multiple use or replaceable. The principle of use is that the rectangles form a frame that the blast resistant material is connected onto in a billows curtain 48 method and the curtain is so connected, possibly unevenly pleated, from side to side, so as to slide along the lengths of the rectangle ring sides into a fully expanded manner. Therefore, as the canopy rectangle is propelled upward and subjected to any force, it has the ability to expand and be subjected to the stress and strain in the horizontal plane through the struts along the respective sides and further being contained by the expanding billows curtain sides. The unfolding nature of the canopy with the rectangular frames with struts included as described have the ability to be stacked in repetition.

A chute 50 may be introduced as a possible arrangement for gas and pressure flow. This chute can be functional by maintaining in the top attachment of the rectangular frame and having a side wall opening but with directional control downward. A chute opening may be placed on any side of the canopy. The chute is a projectile proof mesh with either horizontal or downward orientation. Internal baffles as well as tension bands may also be incorporated in the internal compartment of the canopy so as to control and dampen forces as desired.

The combined components in the bottom containment system and the canopy top containment are so arranged to dissipate the energy field with respect to its vector and by stage of the mine event and respond in a predetermined and controlled manner. A split blast plate with pressure struts can be used. As is the case with many structures that may encounter pressure waves, dissipating, collapsible and compressible medium in layers may contribute to protection of the intended space and surfaces or vacuum control volume may be incorporated on the surfaces or within the containment space in order to mitigate forces to be resisted or deflected.

A centerline path marking system mounted at the rear containment plate is provided whereby a path centerline is prepared with wheel brush and air system and marking with specialized material/paint at coded spaced intervals. The system also automatically paints low spots and where not proofed, unchecked or skipped locations.

Figure 4:
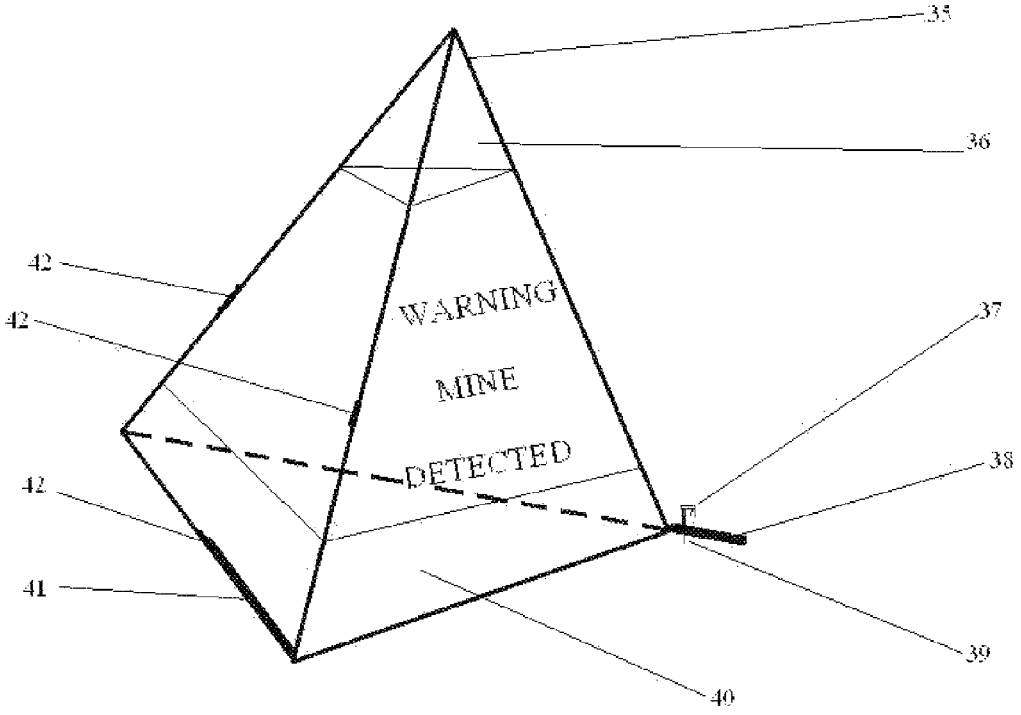
FIG. 4 is a perspective schematic view of a powder actuated warning flag.
Figure 5:
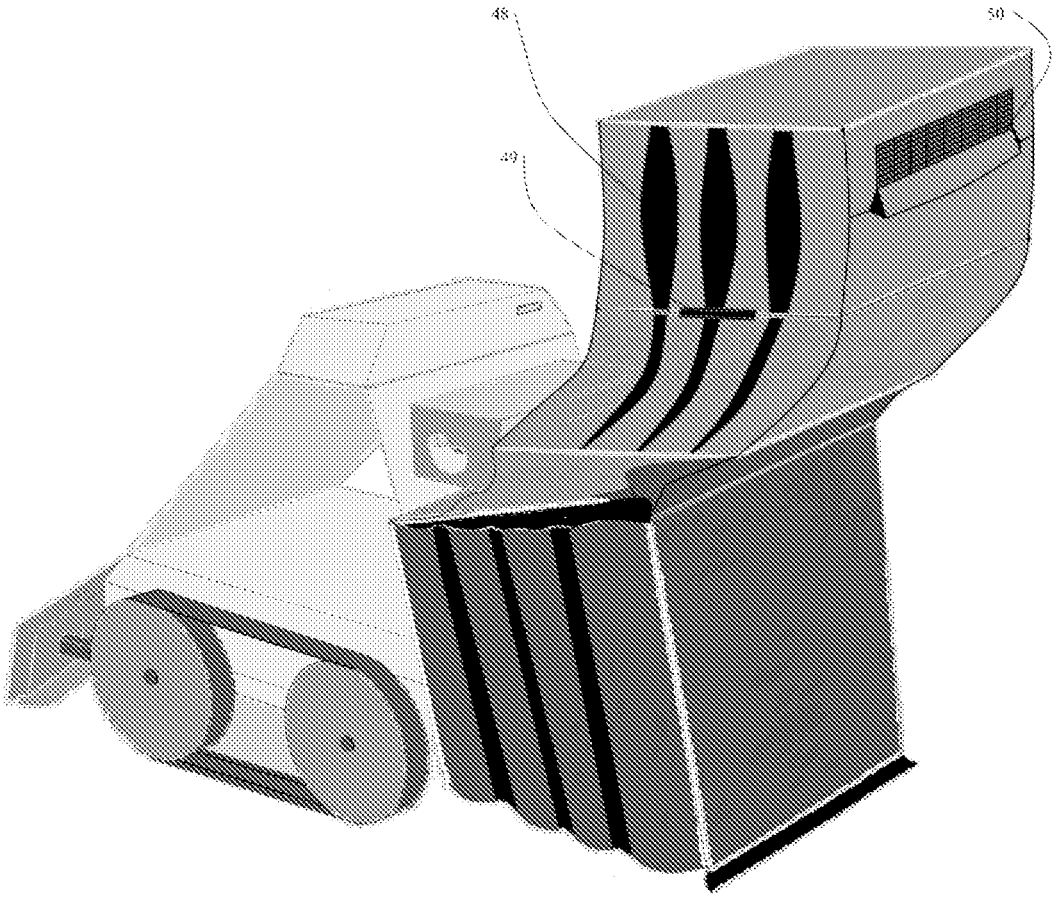
FIG. 5 is a rear perspective schematic view of the exterior of vehicle.

FIG. 1 shows the warning flag tube 6 mounted on the top of the vehicles chassis. FIG. 4 illustrates the detail for the self-contained, remote deployed warning flag system. The vehicle carries a remote deployed powder actuated anchored unfolding warning flag 4 in the top or on the side of the lower chassis body. At this location or mounted onto the side of the chassis a single to several warning flags tubes can be stored. This self-contained function allows the administration of possible deactivation or detonation to be controlled in a more efficient manner in addition to keeping personnel involvement to a minimum for marking the hazard by remotely placing near to located hazards.

The individual flag 35 becomes upright when removed from tube and expand automatically with the individual sides being of flexible spring-to-rod 42 connections. Upon locating the anchor base 38 to its desired location by the operator, the base is positioned and trigger 37 discharged by the use of the robotic arm, securing it into the ground by the powder actuated anchor 39 making the flag spiked into the ground. An additional automatic trigger for discharge may be used at the far base location 41. To aid in the ability to weather wind conditions, the top and base are vented 36 & 40 open to reduce blow over affect.

The invention has been described with respect to particular embodiments, modifications and substitutions within the spirit and scope of the invention and will be apparent to those of skill in the art that individual elements identified herein as belonging to a particular embodiment, may be included in other embodiments of the invention as well. The present invention may be embodied in other specific forms without departing from the attributes herein described. The illustrated embodiments and examples of use should be considered in all respects as examples and illustrative and not restrictive. The devices described herein, individually or in combination may be advantageously be fixed as attachments for or onto other vehicles to achieve desired results which are needed.

I claim:

1. An apparatus on a vehicle for containing landmine blasts, comprising:

a plurality of energy dissipating struts coupled to said a vehicle and a blast plate, wherein said struts are energy absorbing and connected on one end to said vehicle and on the opposite end to said blast plate;

the blast plate having a blast-resistant expanding billows, with a curtain system and an unfolding canopy mounted thereon, the expanding billows, with the curtain system and unfolding canopy providing three dimensional expansion in the event of a landmine detonation;

a strut enclosure having two distinct internal control volumes separated by an internal boundary through which a strut piston extends through;

a solenoid valve controlling flow between said control volumes;

a probe assembly having a spherical ball connection having limited range deflection;

a pressure manifold;

a series of relays with communicating activation lines;

a controller for sequencing and timing; and the manifold having a relay for combining the signals to activate the probe and the strut valve simultaneously together in a cycled manner, controlled by a computer and a controller to synchronize the operation of said components.

2. The apparatus of claim 1, further comprising;

a hinged or sliding mounted mechanism;

having an attachment plate attached to said spline bracket with said hinged or sliding mounted mechanism;

means for raising and lowering the connected strut and probe assembly; and means for pressure relieving for hinged or sliding spline bracket motion during detonations.

3. The apparatus of claim 1, further comprising;

one or a plurality of mine detectors mounted, attached or forming an integral part near to the base of said probe assemblies to initiate pre-blast gas ejection.

4. The apparatus of claim 1, wherein a gas ejection system initiates following a pre-blast signal in the feedback loop system providing downward force.

5. The apparatus of claim 3, further comprising;

a flexible blast resistant probe head boot cover which covers the probe shoe, probe, a mine detector and/or the entire reciprocating probe head assembly.

6. An apparatus on a vehicle or robot for containing landmine blasts, comprising:

a plurality of energy dissipating struts mounted to a vehicle platform and a blast plate, wherein the struts are mounted in an alternating fashion;

the blast plate having a blast-resistant expanding billows, a curtain system and an unfolding canopy mounted thereon, the expanding billows, curtain system and unfolding canopy providing three dimensional expansion in the event of a landmine detonation;

said canopy incorporating a shape forming frame;

an upper curtain billows;

a series of energy absorbing struts connected within the frame;

one or more blast resistant vents with internal baffles; and one or more chutes.

7. A method for defeating antipersonnel mines comprising:

a) using a mobile expandable energy dissipating containment space system of a series of energy absorbing struts connected to a blastplate and flexible curtain billows connected to a chassis;

b) providing a means for triggering said antipersonnel mine within said containment space;

c) detonating said landmine;

e) generating an expanded energy absorbing containment space by extending energy absorbing struts, the blastplate and said billows curtains; and f) absorbing resulting shock wave pressure and containing fragmentation by said energy dissipating system, wherein said system expends work energy and strain energy reacting from the mass of said chassis.

8. The method of claim 7 further comprising detonating the landmine remotely.

* * * * *